United States Patent [19]

Hooykaas

[11] 4,385,657

[45] May 31, 1983

[54] PROCESS FOR AND APPARATUS FOR RECOVERING ENERGY

[75] Inventor: Carel W. J. Hooykaas, Rotterdam, Netherlands

[73] Assignee: Pelt & Hooykaas B.V., Rotterdam, Netherlands

[21] Appl. No.: 127,581

[22] Filed: Mar. 6, 1980

[51] Int. Cl.[3] ..... F28D 21/00

[52] U.S. Cl. ..... 165/1; 165/47; 122/27; 266/231; 136/205

[58] Field of Search ..... 122/6 R, 27, DIG. 13; 110/238, 336, 343; 432/85; 266/231; 126/901; 165/47, DIG. 6, 133, 180, 1; 136/205, 212, 225, 230

[56] References Cited

U.S. PATENT DOCUMENTS

| | | | |
|---|---|---|---|
| 746,240 | 12/1903 | Baggaley | 122/27 |
| 1,166,745 | 1/1916 | Daily | 122/27 |
| 1,585,892 | 5/1926 | Clutts | 266/99 |
| 1,624,602 | 4/1927 | Jacobus et al. | 122/27 |
| 1,802,695 | 4/1931 | Bennett | 165/180 |
| 2,038,765 | 4/1936 | Shahan | 122/27 |
| 4,075,376 | 2/1978 | Jaeger | 165/133 X |
| 4,082,907 | 4/1978 | Schardein et al. | 126/901 X |
| 4,111,159 | 9/1978 | Okuno et al. | 122/27 |
| 4,217,954 | 8/1980 | Vincent | 165/133 |
| 4,268,586 | 5/1981 | Hanneman et al. | 165/133 X |
| 4,312,915 | 1/1982 | Fan | 126/901 X |

FOREIGN PATENT DOCUMENTS

| | | |
|---|---|---|
| 578633 | 10/1924 | France . |
| 195267 | 3/1923 | United Kingdom . |

*Primary Examiner*—Samuel Scott
*Assistant Examiner*—Margaret A. Focarino
*Attorney, Agent, or Firm*—Burton, Parker & Schramm

[57] ABSTRACT

A process for recovering energy from substances having a high temperature, in particular for recovering energy from molten slag material obtained in metallurgical processes, the heat being emitted by said substances by radiation, being recovered in regions, positioned at distance from said substances. In case of liquid substances such as molten slag material, this is conveyed during the recovery of radiation heat.

16 Claims, 3 Drawing Figures

PROCESS FOR AND APPARATUS FOR RECOVERING ENERGY

BACKGROUND OF THE INVENTION

1. Field of the Invention

The present invention relates to a process for recovering energy from substances having a high temperature and in particular to a process for recovering energy from molten slag material obtained in metallurgical processes.

2. Description of the Prior Art

Molten slag material produced in blast furnaces and in phosphor furnaces, having a temperature of 1200° C., is in the prior art cooled by means of water, thereby producing steam. Said steam being released, however, in a rather large space, cannot be used economically.

As molten slag material arrives at a temperature of about 1200° C. from the blast furnace into a pit through a refractory brick gutter, this heat might be recovered by applying steel instead of refractory brick gutters and by cooling said steel gutters by means of a circulating liquid energy absorbing fluid, such as for example water. When draining off said molten slag material, liquid iron might be entrained from time to time, however. Said liquid iron would burn immediately through said steel gutters, which might cause an explosive contact between the liquid iron having a high temperature, and the circulating water. Although instead of water, for example a liquid silicon oil could be employed, no improvement will occur in the latter case, as then the explosive reaction would take place between said silicon oil and the liquid iron.

French Pat. No. 2,345,664, entitled "Recovering heat from molten metal slag from metallurgical treatments" issued to Kawasaki Yukogyo Kabushiki Kaisha on Oct. 10, 1977 teaches the recovery of radiation heat from molten slag by positioning metal tubes over the molten slag, radiation heat is absorbed by water flowing through these tubes. The difficulty with this method is that it is disadvantageous, as the tubes must be held at important distances from the slag, in order to avoid damage to the tubes. Moreover, no optimum recovery of radiation heat is obtained.

French Pat. No. 578,633, entitled "Coal gas, heating, cooling, ventilation", issued to Johann Heinrich Stein on Oct. 1, 1924 teaches a method to recover radiation heat from slag material by means of water present in a hollow container. This method presents the same disadvantages as mentioned hereinbefore.

U.S. Pat. No. 2,038,765, issued to Frank L. Shahan on Apr. 28, 1936, entitled "Heat filter device" teaches the recovery of radiation heat from slag material by means of water present in tubes. The difficulty with this device is that the tubes are surrounded by a layer of clay material both as an insulator and for absorbing and storing heat. Much radiation heat is lost by this layer.

U.S. Pat. No. 1,585,982, issued to Joshua K. Clutts on May 25, 1926, entitled "Blast furnace" teaches the recovery of heat from slag material by means of a boiler. The difficulty with this device is that much radiation heat is lost in this way.

British Pat. No. 195,267, issued to Sulzer Freres S. A. on Apr. 19, 1929, entitled "Process and apparatus for the pouring and cooling of castings" discloses the recovery of heat from slag material by means of a boiler.

The difficulty with this process is that much radiation heat is also lost here.

SUMMARY OF THE INVENTION

In view of the foregoing factors and conditions of the prior art it is a primary object of the present invention to provide a process for recovering energy from substances having a high temperature and in particular from molten slag material obtained in metallurgical processes, whereby the abovedescribed disadvantages will not occur.

This object is attained in accordance with the invention in that the heat emitted by said substances by radiation is recovered in regions being positioned at distance from said substances.

A process of this type is very appropriate in that the recovery of the radiation heat does not take place in regions being in contact with said aforementioned hot substances, such as e.g. molten slags which sometimes contain liquid iron. Any explosion danger owing to a contact of substances used for the recovery of heat, and liquid iron, is therefore absolutely precluded.

It is another advantage of the present invention that, notwithstanding an excellent heat recovery, for instance when conveying said material through gutters, the flowing molten slag material may be observed continuously, as said molten slag material sometimes contains big lumps which could give rise to obstructions in the gutters. If the slag flowing through the gutters could not be inspected in the process of the invention, this might lead to big dangers as far as damages to gutters or to the apparatus being used for the recovery of heat, including dangers to the operators of said apparatus, is concerned.

It is still another object of the present invention to provide apparatus for the recovery of heat consisting of radiation energy collectors absorbing the emitted radiation energy in regions being positioned at distance from the aforementioned substances.

According to an advantageous embodiment of the present invention the heat radiation is recovered by radiation energy cell systems.

Very advantageously the radiation heat is recovered by applying an intermediate corrosion-resistant layer, being positioned at distance from the substance.

Preferably conducting layers are used, consisting of a metal of the sixth group from the Periodical System, particularly molybdenum, which is used, e.g. as a molybdenum sheet. Said molybdenum sheet may have thicknesses corresponding to foil thicknesses, e.g. a thickness of for instance 0,01 mm buth thicker molybdenum sheets may also be used. An effective upper limit is approximately 1 mm.

The use of molybdenum is very convenient as said material is corrosion-resistant, a property which is in this case very advantageous in view of corrosive fumes, smokes and the like emitted by molten slag material.

A sheet consisting of molybdenum will moreover reflect half of the emitted radiation to the slag material, which is appropriate since the upper surface of the slag material will consequently be re-heated so that the flowing properties of the slag material are being maintained entirely.

Furthermore such a sheet offers the advantage that much longer gutters may be used, resulting in an optimum recovery of the radiation heat.

It has been found that in a process according to the invention a considerable percentage of the emitted radiation may be recovered as under these conditions, the radiation of the slag material will not cause a decrease of the flowing properties of said material such, that the material is more difficult to convey.

Instead of the abovementioned slag material as heat emitting substances, the products may also consist of cast metal products, particularly iron castings having large dimensions, said castings also comprising large quantities of heat, which heat may be recovered by radiation.

In each case a corresponding type of radiation energy collector cell has to be used being responsive to the respective energy spectrum. Suitable collectors operate with a eV of 0,2 to 0,7 and preferably of 0,25 eV. In this manner especially the radiation energy being emitted in the spectrum, ranging from 550° C. to 1400° C., is absorbed.

The present invention also relates to apparatus for recovering energy from products having a high temperature, particularly from molten slag material obtained in metallurgical processes, said apparatus being provided with a radiation energy recovery system being positioned at distance from the substances presenting high temperatures.

Said apparatus for recovering energy from products having high temperatures, particularly comprises a gutter consisting of a refractory material, the radiation energy cell systems being disposed at distance above the upper side of said gutter.

In between the radiation energy cell systems and the gutter a corrosion-resistant layer is advantageously positioned at distance from the medium to be transferred through the gutter.

Said corrosion-resistant layer conveniently consists of a metal sheet, of a metal from the sixth group of the Periodical System, preferably of a molybdenum sheet having at least a thickness of 0,01 mm.

The features of the present invention which are believed to be novel are set forth with particularity in the appended claims.

Other claims and many of the attendant advantages will be more readily appreciated as the same becomes better understood by reference to the following detailed description and considered in connection with the accompanying drawings in which like reference symbols designate like parts throughout the figures.

DESCRIPTION OF PREFERRED EMBODIMENTS

Figure 1:
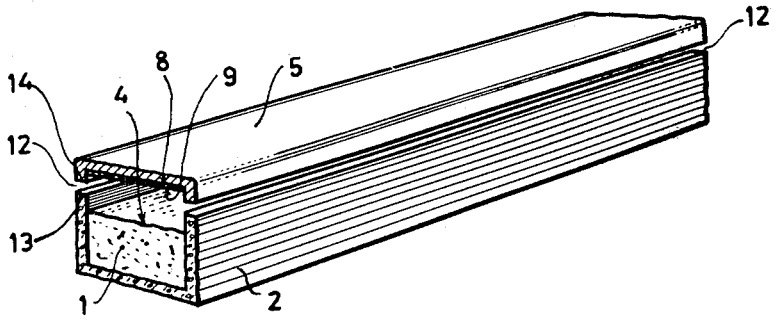
FIG. 1 diagrammatically shows a gutter for conveying molten slag material.

In order to best understand the present invention a description of preferred embodiments thereof is provided accompanied by drawings. In FIG. 1 a transport gutter 2 is shown, consisting of refractory bricks. Said gutter 2 serves for transferring molten slag material 1 as drained off from a blast furnace. Said slag material arrives in said gutter at a temperature of about 1200° C.

Efforts have been made to replace the refractory brick material of the gutter 2 by e.g. double-walled steel gutters and by having water or another suitable fluid circulate through the walls of said gutter. In the latter case a recovery of heat has proved to be rather difficult, however, due to the presence of molten iron having a high temperature, in the aforementioned molten slag material thereby damaging the steel gutters.

Above the gutter 2, to wit at distance from the level 4 of the molten slag material 1, a radiation energy collector 5 is accomodated of a type known per se. Said radiation energy collector of 0,25 eV recovers heat being emitted by the molten slag material. The energy collected by said collector is emitted to an energy accumulator 6 from which other installations 7 may be fed.

Said radiation energy collector 5 is effectively protected against the action of corrosive fumes and smoke, being emitted from the molten slag material, by the presence of an intermediate sheet 9 of molybdenum material, having a thickness of about 0,01 mm and being disposed between the active surface 8 of the radiation energy collector and the level 4 of the molten slag material.

Said molybdene sheet 9 will reflect half of the radiation emitted, upon the molten slag material, thus causing said material to be re-heated, so that an optimum radiation of the slag material is maintained.

The presence of said molybdenum sheet 9 is the more important as presently gutters may be used the length of which is considerably increased as, due to the abovedescribed feature, the flowing properties of the molten slag material will be optimally maintained, while furthermore a recovery of radiation heat may also be performed to an optimum extent.

On summarizing the features of the process according to the present invention, it is obvious that the greater part of the radiation being emitted by molten slag material of 1200° C., may be recovered.

Figure 3:
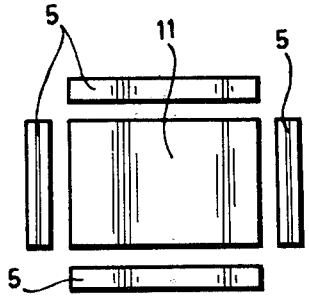
FIG. 3 is a plan view of an iron product having a high temperature and being surrounded by radiation energy collectors.

Referring now to FIG. 3, a further embodiment of the present invention shows a cast iron block 11 being surrounded by radiation energy collectors 5 which absorb the radiation heat being emitted from said block and thus recover said radiation heat.

Figure 2:
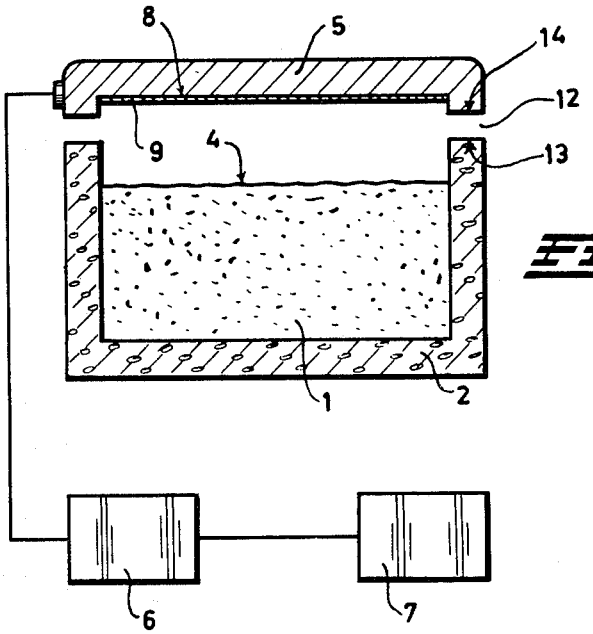
FIG. 2 is a cross section of such a gutter including a radiation energy collector cell system, being disposed thereabove.

Referring now to the configuration of FIG. 2 a clearance 12 exists between the upper edge 13 of the gutter 2 and the lower edge 14 of the radiation energy collector 5. Said clearance 12 permits a continuous inspection of the molten slag material 1 in the gutter 2. Since frequent obstructions may occur in said gutter 2 because of the presence of lumps in the molten slag, the equipment of the radiation energy collectors should preferably consist of small parts which may easily be removed from the upper side of the gutter.

Obviously a recovery of energy from molten slag material in blast furnaces should be performed discontinuously, as said slag material is released when discharging a charge from a blast furnace.

The process in accordance with the invention may be performed continuously in phosphor slag furnaces, as molten phosphor slag material is continuously conveyed through the gutters.

The average height of the gutters is approximately 20 cm while the active bottom surface has a width of about 30 cm.

The cast iron blocks 11 in FIG. 3 may obviously be disposed upon a movable support being surrounded at three points by radiation energy collectors; after having disposed said block 11 upon said movable support, an additional fourth radiation energy collector 5 is mounted.

What is claimed is:

1. A process for recovering energy from a molten slag-like substance comprising the steps of:

(a) positioning a radiation energy collector at an effective distance for collecting energy from the substance;

(b) passing the substance by the collector;

(c) placing a corrosion resistant layer comprised of a metal taken from the 6th group of the Periodic Table and having a thickness of between 0.01 mm and 1 mm between the collector and the substance to protect the collector; and (d) reflecting a portion of the energy from the layer back onto the molten substance to maintain the flow properties thereof; and (e) recovering a portion of the energy from the substance by the energy collector.

2. The process of claim 1, further comprising the step of transmitting energy from the radiation energy collector to an energy accumulator.

3. The process of claim 1, wherein the metal from the sixth group of the Periodic System is molybdenum.

4. The process of claim 3, further comprising the step of reflecting about half of the substance's radiated heat from the molybdenum layer.

5. The process of claim 1 wherein the radiation energy collector is of the type operating at a range of 0.2 to 0.7 electron volts (eV).

6. The process of claim 1 wherein the radiation energy collector is of the type operating at a temperature range from 550° C. to 1400° C.

7. Apparatus for recovering energy from a molten slag-like substance having a high temperature, comprising a radiation energy collector, for placement at an effective distance from the substance having a high temperature; and a corrosion resistant layer comprised of a metal from the 6th group of the Periodic Table for placement intermediate the collector and the substance, said layer having a thickness of at least 0.01 mm and at most 1 mm;

wherein the corrosion resistant layer is designed to reflect a portion of the energy back onto the molten substance to maintain the flow properties thereof; and wherein the corrosion resistant layer is designed to allow a portion of the energy to pass to the energy collector.

8. The apparatus of claim 7 wherein the corrosion resistant layer is comprised of molybdenum.

9. The apparatus of claim 8 wherein the radiation energy collector is of the type capable of operating at a temperature range of 550° C. to 1400° C.

10. The apparatus of claim 8 wherein the radiation energy collector is one capable of operating at 0.2 to 0.7 electron volts (eV).

11. The apparatus of claim 7, further comprising a gutter for carrying the substance from which heat is to be collected; wherein the gutter is positioned at a distance below the energy collector, providing a clearance between the energy collector and the gutter.

12. The apparatus of claim 7, wherein the corrosion-resistant layer is comprised of molybdenum.

13. The apparatus for recovering energy from molten slag-like substances, comprising:

(a) a gutter for transferring molten slag-like substances;

(b) a radiation energy collector being effectively disposed at a distance from the gutter for collecting energy from the slag-like material which is transferred therethrough;

wherein the radiation energy collector is of the type that translates radiant energy into electrical energy;

(c) a corrosion resistant layer comprising a metal taken from the 6th group of the Periodic Table, and having a thickness of between 0.01 mm and 1 mm;

wherein the layer is intermediate the collector and the gutter;

wherein the corrosion resistant layer is designed to reflect a portion of the energy back onto the molten substance to maintain the flow properties thereof; and wherein the corrosion resistant layer is designed to allow a portion of the energy to pass to the energy collector.

14. The apparatus of claim 13 wherein the corrosion resistant layer is comprised of molybdenum.

15. The apparatus of claim 13 wherein the radiation energy collector is of the type capable of operating at a temperature range of 550° C. to 1400° C.

16. The apparatus of claim 13 wherein the corrosion resistant layer is comprised of molybdenum.

* * * * *

UNITED STATES PATENT OFFICE

CERTIFICATE OF CORRECTION

Patent No. 4,385,657 Dated May 31, 1983

Inventor(s) CAREL W. J. HOOYKAAS

It is certified that error appears in the above-identified patent and that said Letters Patent are hereby corrected as shown below:

Column 1, line 60, delete "1,585,982" and insert --- 1,585,892 --- .

Signed and Sealed this

Sixteenth Day of August 1983

[SEAL]

Attest:

GERALD J. MOSSINGHOFF

Attesting Officer

Commissioner of Patents and Trademarks